United States Patent [19]

Mochida

[11] Patent Number: 4,508,379

[45] Date of Patent: Apr. 2, 1985

[54] LOCKING DEVICE OF AN AUTOMOTIVE DOOR

[75] Inventor: Haruo Mochida, Yokohama, Japan

[73] Assignee: Nissan Motor Company, Limited, Japan

[21] Appl. No.: 398,660

[22] Filed: Jul. 15, 1982

[30] Foreign Application Priority Data

Aug. 19, 1981 [JP] Japan ..... 56-130606

[51] Int. Cl.[3] ..... E05B 3/00

[52] U.S. Cl. ..... 292/336.3; 292/216; 292/346; 292/DIG. 62

[58] Field of Search ..... 292/DIG. 62, 216, 218, 292/196, 346, 336.3; 74/104, 519; 180/282

[56] References Cited

U.S. PATENT DOCUMENTS

| | | | |
|---|---|---|---|
| 2,782,062 | 2/1957 | Smith | 292/216 |
| 3,649,061 | 3/1972 | Meyer . | |
| 3,697,105 | 10/1972 | Marx | 292/216 |
| 3,999,791 | 12/1976 | Torii | 292/216 |
| 4,005,887 | 2/1977 | Itakura | 292/216 |
| 4,113,294 | 9/1978 | Bierman . | |
| 4,196,925 | 4/1980 | Torii | 292/216 |
| 4,364,590 | 12/1982 | Hamada | 292/216 X |
| 4,382,622 | 5/1983 | Ishikawa | 292/216 |

FOREIGN PATENT DOCUMENTS

| | | |
|---|---|---|
| 2815747 | 12/1978 | Fed. Rep. of Germany . |
| 1492020 | 9/1965 | France . |
| 678237 | 3/1951 | United Kingdom . |

*Primary Examiner*—Gary L. Smith
*Assistant Examiner*—Thomas J. Dubnicka
*Attorney, Agent, or Firm*—Lowe, King, Price & Becker

[57] ABSTRACT

A door locking device having a high anti-theft performance is herein disclosed. The device comprises a catching device mounted in the door and including a hook member and a lever member, the hook member being locked when the lever member is moved in a direction and unlocked when the lever is moved in an opposite direction; a key cylinder rotatably mounted to the door, the key cylinder being rotatable about the axis thereof only when handled by a specified key; an arm securely connected to an end of the key cylinder and extending therefrom radially outwardly; a rod pivotally connected to the arm and extending therefrom toward the lever member, so that rotation of the key cylinder about the axis thereof induces an axial movement of the rod; and a play providing device interposed between the extending end of the rod and the lever member, so that a play is permitted between the rod and the lever member upon relative movement therebetween.

11 Claims, 10 Drawing Figures

LOCKING DEVICE OF AN AUTOMOTIVE DOOR

BACKGROUND OF THE INVENTION

The present invention relates in general to an anti-theft device of an automobile, and more particularly to a locking device for an automotive door, operable to lock and unlock the door from outside the vehicle.

SUMMARY OF THE INVENTION

It is an object of the present invention to provide a locking device of an automotive door with improved anti-theft performance.

According to the present invention, there is provided a locking device of an automotive door, which comprises a catching device mounted in the door and including a hook member and a lever member. The hook member being locks and unlocks when the lever member moves respectively in first and second directions. A key cylinder rotatably mounted to the door is rotatable about an axis thereof only when handled by a specified key. An arm is securely connected to an end of the key cylinder and extends radially outward. A rod pivotally connected to the arm extends therefrom toward the lever member so that rotation of the key cylinder induces axial movement of the rod. A device interposed between the extending end of the rod and the lever member provides play between rod and the lever member upon relative movement therebetween.

BRIEF DESCRIPTION OF THE DRAWINGS

Other objects and advantages of the present invention will become clear from the following description when taken in conjunction with the accompanying drawings, in which.

DESCRIPTION OF THE PRIOR ART

Prior to describing the door locking device of the present invention, one conventional locking device will be described with reference to FIGS. 1 to 3 in order to clarify the invention.

Figure 1:
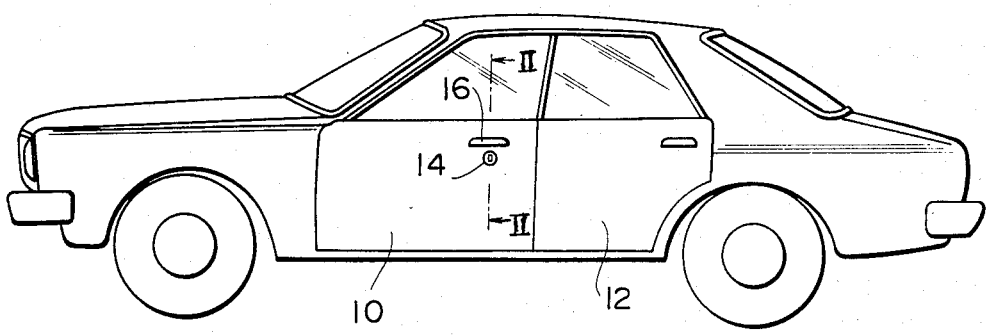
FIG. 1 is a side view of an automobile having a door equipped with a door locking device.

Referring to FIG. 1, an automobile includes conventional doors 10 and 12. Front door 10 has a door locking device for locking/unlocking the door with a key from outside the vehicle. A key cylinder unit 14 of the device is mounted to door 10 at a position below a door handle 16 as will be understood from the following description.

Figure 2:
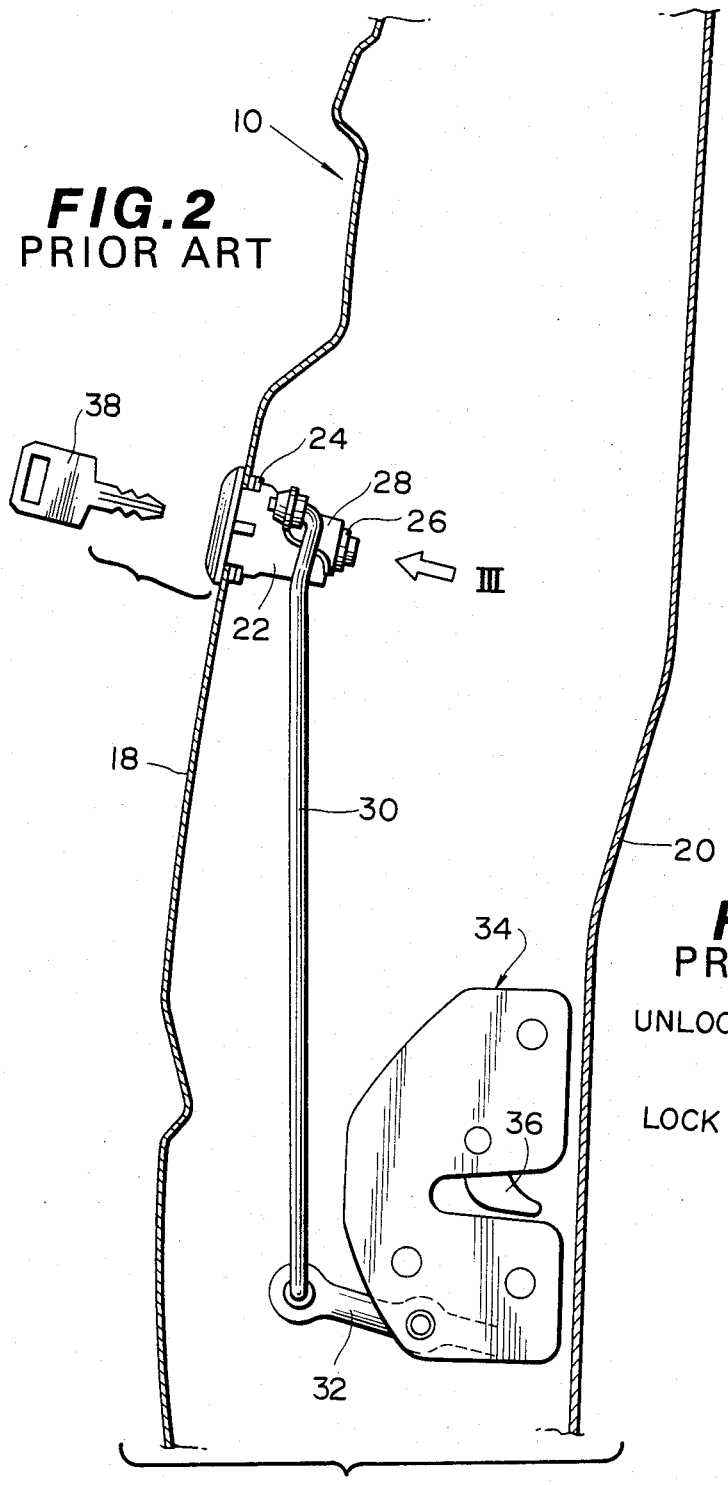
FIG.2 PRIOR ART
FIG. 2 is a sectional view of a conventional door locking device, taken along a line II—II of FIG. 1.
Figure 3:
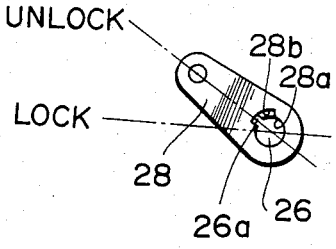
FIG.3 PRIOR ART
FIG. 3 is a view taken from the direction of arrow III of FIG. 2.

A conventional door locking device is shown in FIGS. 2 and 3. The device is mounted in a door 10 having an outer panel 18 and an inner panel 20. The device comprises a cylindrical case 22 securely connected, by means of retaining clip 24, to the outer panel 18 with its enlarged flanged open end outside door 10. A key cylinder or rotor 26 is rotatably received in the case 22 and has an arm 28 which extends radially outward. The leading end of the arm 28 is pivotally connected to an end of a rod 30. The other end of the rod 30 is pivotally connected to a pivoting lever 32 of a catching device 34. The catching device 34 includes a pivotally moving hook 36 which is biased to assume the illustrated position. The hook 36 locked/unlocked in response to pivotal movement of lever 32 in a given direction. Although not shown in the drawing, a lock striker is mounted to a suitable portion of the vehicle body, such as a center pillar, for catching door-mounted hook 36 upon closing of door 10.

To locking door 10, key 38 rotates key cylinder 26 in a given direction (e.g., clockwise in FIG. 2). So that rod 30 moves downward, inducing downward pivotal movement of lever 32 to lock hook 36 and thereby, door 10. Door 10 is unlocked by turning key 38 in the opposite direction.

Connection between key cylinder 28 and arm 26 is best shown by FIG. 3. The key cylinder 26 is formed with a projection **26*a* on its cylindrical end. The arm 28 has a circular opening 28*a* with a concentric recess 28*b*. The cylindrical end of the key cylinder 26 is received in the circular opening 28 with the projection 26*a* located in the recess 28*b*. For effecting considerable play of the key cylinder relative to the arm 28, the effective length of the recess 28*b* is greater than the thickness of the projection 26*a*. The reason of providing play is as follows: First, once the catching device 34 (and thus the hook 36) is locked by turning key 38 in the given direction, the return turning of the key 38 toward its neutral position should not induce the return movement of the rod 30 which causes cancelling of the locked condition of the device 34. In fact, the key 38 can not be drawn out from the key cylinder 28 until the latter is brought into the neutral position. Second, the presence of such play induces a desirable positional relationship betwen the projection 26*a* of the key cylinder 26 and the concentric recess 28*a* of the arm 28 when the key cylinder 26 is brought or returned to its neutral position after locking the door. At this time, the projection 26*a* is in contact with or at least close to one longitudinal end of the concentric recess 28*b* to instantly unlock door 10 upon turning of key 38** in the opposite direction from the neutral position.

The above-mentioned door locking device is easily tampered with. When key 38 is removed from key cylinder 26 after locking the door, projection **26*a* of the key cylinder is positioned close or in contact with the longitudinal one end of the recess 28*b*. In this condition, arm 28 is movable about the key cylinder until the other longitudinal end of the recess 28*b* is brought into contact with the projection 26*a* of the key cylinder which is then locked. The direction of movement arm 28 thus permitted moves rod 30 upward, unlocking catching device 34. This movement of arm 28 is undesirable since a pick (e.g., a hooked wire or the like), wrongfully inserted in the door assembly from outside can unlock the door. In fact, simply pulling arm 28 and/or rod 38 upward with a hooked wire easily unlocks catching device 34**.

DESCRIPTION OF THE INVENTION

Therefore, it is an essential object of the present invention to solve the above-mentioned drawbacks encountered in the conventional door locking device.

Figure 4:
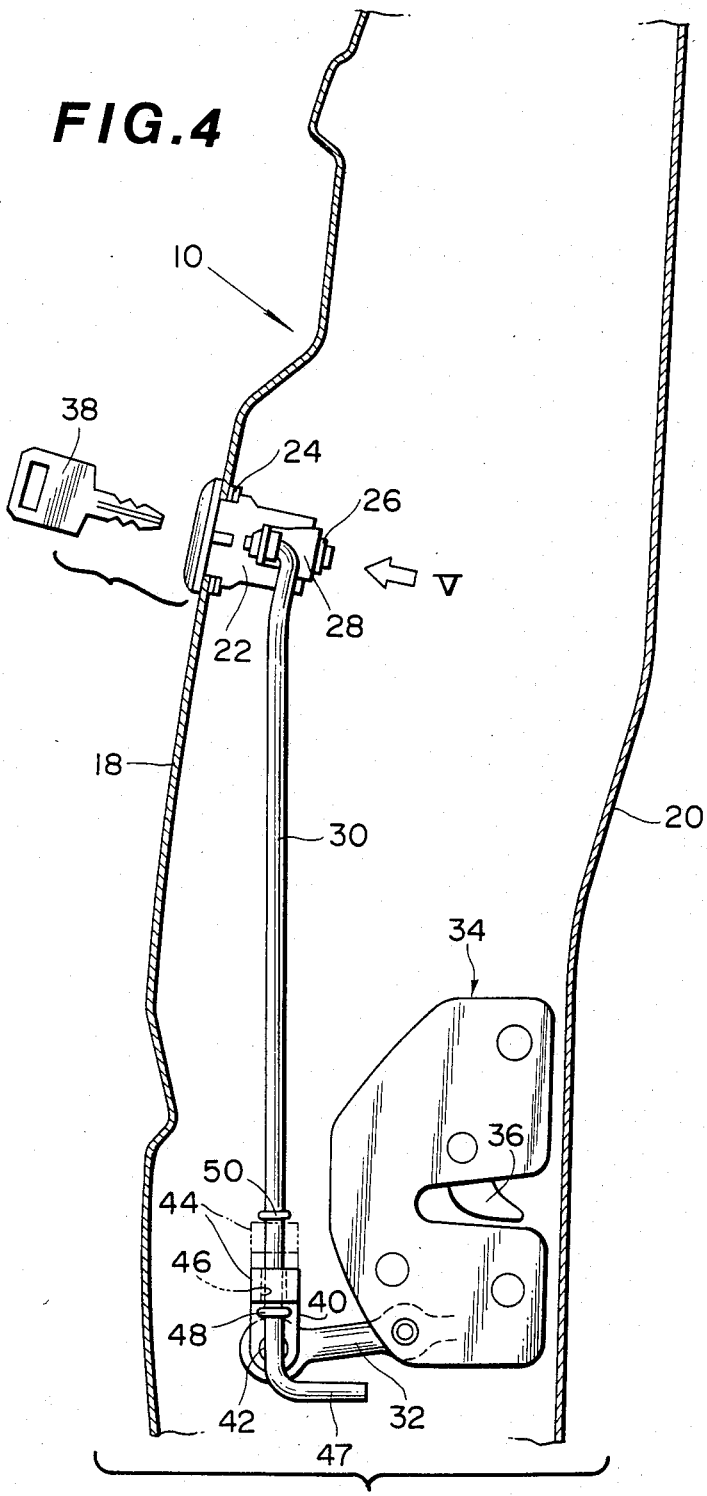
FIG. 4 is a view similar to FIG. 2, but showing a first embodiment of the present invention.
Figure 5:
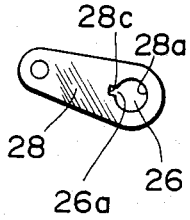
FIG. 5 is a view taken from the direction of the arrow V of FIG. 4.

Referring to FIGS. 4 and 5, there is shown a first embodiment of the present invention. In the drawings, the parts corresponding to those of the above-mentioned conventional device are designated by the same numerals. In the following, detailed description of such parts is omitted for facilitation.

In the door locking device of the first embodiment according to the present invention, the arm 28 is tightly connected to the end of the key cylinder 26, unlike the above-mentioned conventional device. In particular, as is seen from FIG. 5, the projection 26*a* of the key cylinder 26 is snugly received in a small recess 28*c* of the arm 28 in a manner to form a so-called spline connection therebetween. Thus, there is no play between the key cylinder 26 and the arm 28.

In this embodiment, the play required is provided by a play providing device interposed between the rod 30 and the pivoting lever 32 of the catching device 34. The play providing device comprises a rod holder 40 pivotally connected to the pivoting lever 32 by a pivot pin 42. The holder 40 is formed with a projection 44 having therein a through hole 46. The rod 30 slidably passes through the hole 46. The leading end portion 47 of the rod 30 is bent toward the catching device 34. Two spaced stoppers 48 and 50 are secured to the rod 30 in a manner to spacedly put therein the perforated projection 44 of the holder 40. Thus, within a given range, the axial movement of the rod 30 is achieved without causing the pivotal movement of the lever 32.

When locking door 10, key 38 engaged with key cylinder 26 is turned in a given direction to move rod 30 downward. This movement causes the stopper 50 to push the perforated projection 44 of the holder 40 downward to the position indicated by a solid line. With this movement of the holder 40, the lever 32 is pivoted downward thereby bringing the catching device 34 (or the hook 36) into the locked condition. Under this condition, the stopper 48 of the rod 30 is spaced from perforated projection 44 of the holder 40. Then, the key 38 is turned in the opposite direction bringing the key cylinder 26 into the neutral position, and drawn out from the key cylinder 26. The upward movement of the rod 30 thus induced by this returning key cylinder 26 does not affect the catching device 34 because of the play of the stopper 48 relative to the holder 40. At this time, the holder 40 assumes the position indicated by a solid line in FIG. 4. Preferably, in this condition, the stopper 48 is in contact with or at least close to the perforated projection 44 of the holder 40 for reasons below.

To unlock the door 10, key 38 is inserted in key cylinder 26 from outside and turned in the opposite direction. Rod 30 lifts, causing stopper 48 to push the perforated projection 44 upward thus moving the lever 32 upwardly. Catching device 34 is unlocked. Because of close contact between stopper 48 and projection 44 in the neutral position of key cylinder 26, counter-clockwise turning of key 38 induces instant unlocking of catching device 34. Then, key 38 is turned clockwise, rotating key cylinder 26 toward the neutral position for drawing out the key. The downward movement of the rod 30 thus induced by the returning key cylinder 26 does not affect the catching device 34 because of the play of the stopper 48 relative to the perforated projection 44. Thus, the perforated projection 44 remains in the position indicated by a phantom line in FIG. 4, keeping the catching device 34 in the unlocked condition. In this condition, the stopper 50 is in contact with or at least close to the perforated projection 44 of the holder 40, which is ready for instant locking of the door 10 upon the clockwise turning of the key 38 from the neutral position.

As is described hereinabove, in the locked condition of the door 10, the parts of the locking device assume the respective positions indicated by the solid line in FIG. 4. It is to be noted that the key cylinder 26 is kept locked until the specified key 38 is operatively engaged with the key cylinder 26. Accordingly, in the condition of FIG. 4, the arm 28 and thus the rod 30 can not be moved by a tool other than the key 38. This means that the locked condition of the catching device 34 can not be cancelled by a foreign tool, such as a hooked wire or the like, wrongfully inserted in the door assembly from the outside. Even though the lever 32 of the catching device 34 in this condition is movable upward, that is, in a direction to cancel the locked condition of the device 34, the bent a leading end portion 47 of the rod 30 prevents the pick from engaging with the lever 32.

Figure 6:
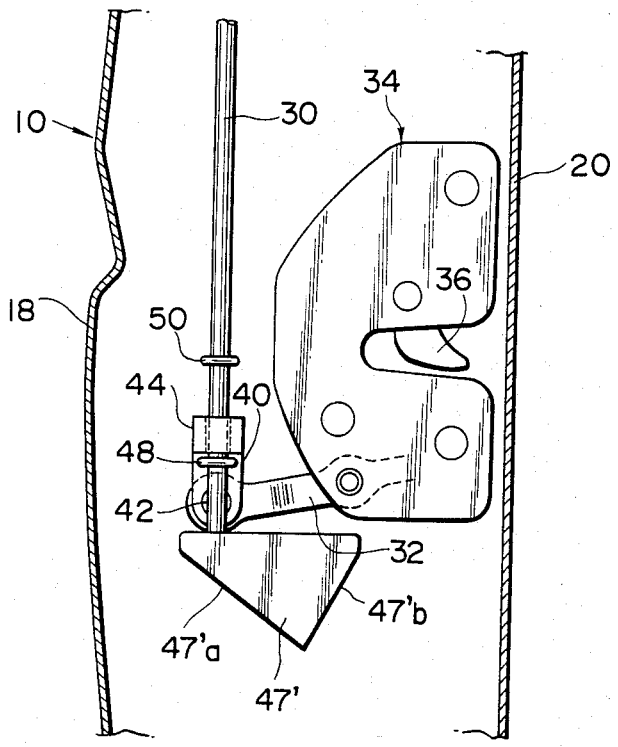
FIGS. 6 and 7 are views respectively showing modifications of the first embodiment of FIG. 4.

Referring to FIG. 6, there is shown a modification of the first embodiment. In this modification, a triangular prism member 47' is fixed to the lower end of the rod 30. The two inclined sides 47'*a* and 47'*b* are effective in preventing the pick from engaging with the lever 32. In fact, sides 47'*a* and 47'*b* are effective in guiding such tool toward the outside.

Figure 7:
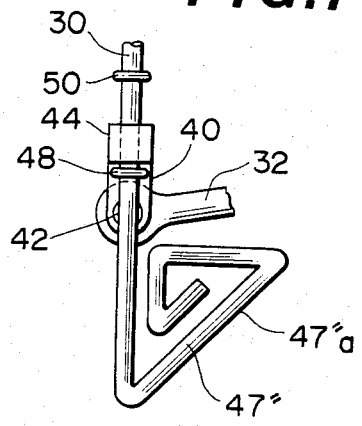

Referring to FIG. 7, there is shown another modification of the first embodiment. In this modification, the end portion of the rod 30 is shaped like a triangular spiral 47'' having an inclined side 47''*a*.

Figure 8:
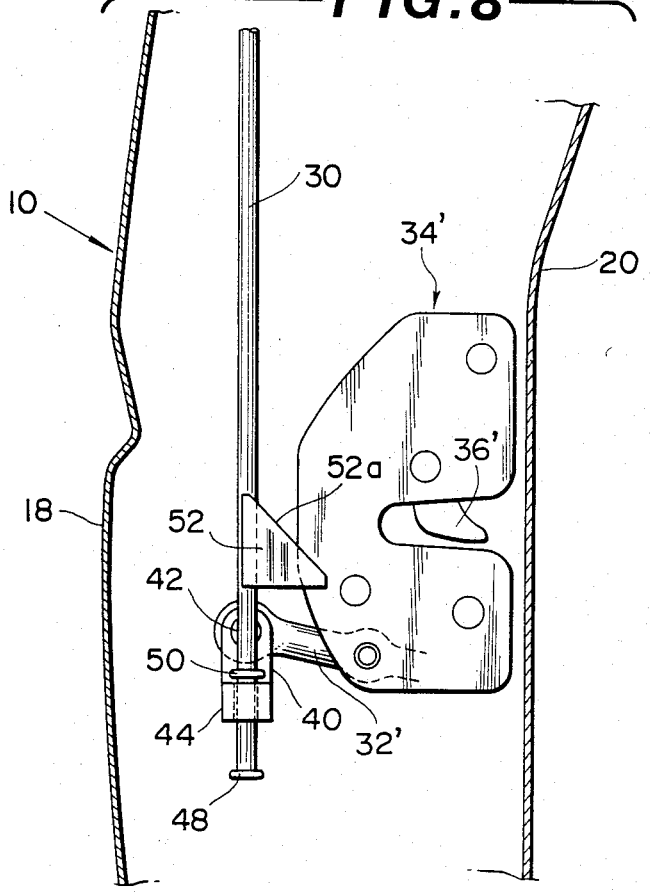
FIG. 8 is a view similar to FIG. 2, but showing a second embodiment of the present invention.

Referring to FIG. 8, there is shown a second embodiment of the present invention. In this embodiment, the catching device 34' is of a type, unlike that of the first embodiment, in which locking thereof is achieved by upward movement of the lever 32', while, unlocking is by downward movement of the lever. The play providing device of this second embodiment comprises a rod holder 40 pivotally suspended from lever 32' via pin 42. The rod holder 40 is formed with a perforated projection 44 through which the lower end portion of rod 30 slidably extends. Two spaced stoppers 48 and 50 are secured to the rod 30 in a manner to spacedly put therebetween the projection 44. A triangular member 52 having an inclined side 52*a* is fixed to the rod 30 at a position slightly above the lever 34. Even though the lever 32' of the catching device 32' in this condition is movable downward, that is, in a direction to cancel the locked condition of the device 34', the triangular member 52 prevents the pick from engaging with the lever 32'. Of course, the rod 30 can not be moved at this condition.

Figure 9:
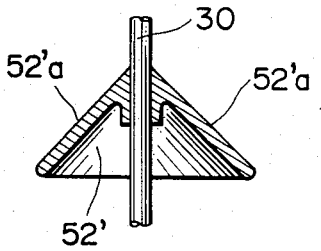
FIG. 9 is a view showing a modification of the second embodiment of FIG. 8.

Referring to FIG. 9, there is shown a modification of the second embodiment. In this modification, a conical member 52' having a circular cone surface 52'*a* is employed as a substitute for the triangular member 52 of the second embodiment. If desired, a pyramid-shaped member may be used.

Figure 10:
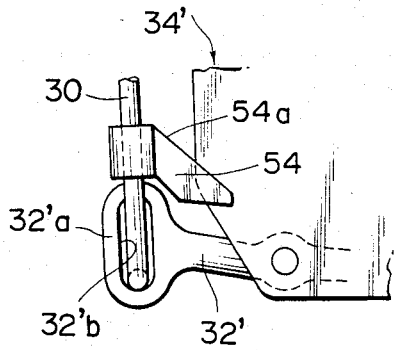
FIG. 10 is a partial view showing a third embodiment of the present invention.

Referring to FIG. 10, there is shown a third embodiment of the present invention. In this embodiment, the catching device 34' is of the same type as the second embodiment of FIG. 8. The play providing device of this third embodiment comprises an enlarged end portion 32'*a* of the lever 32'. The portion 32'*a* is formed with an elongated opening 32'b through which a bent end portion of the rod 30 passes slidably. Thus, the rod 30 has a play, relative to the lever 32', corresponding to the longitudinal length of the elongated opening 32'b. A member 54 having an inclined side is secured to the rod 30 for preventing the pick from engaging with the lever 32'.

As is understood from the foregoing description, in the present invention, the movement of the rod 30 is not permitted by a tool other than the specified key 38. Furthermore, engaging the pick with the lever 32 or 32' of the catching device 34 or 34' is effectively prevented by the so-called protector 47, 47', 47'', 52, 52' or 54. Thus, high anti-theft performance is expected from the present invention.

What is claimed is:

1. A locking device of an automotive door, comprising:

a catching device mounted in said door and including a hook member and a lever member, said hook member being locked when said lever member moves in a first direction and unlocked when said lever member moves in a second direction;

a key cylinder rotatably mounted to said door, said key cylinder being rotatable about an axis thereof relative to said door only when handled by a specified key inserted in said key cylinder;

an arm securely connected to an end of said key cylinder and extending radially outward therefrom;

a rod pivotally connected to said arm and extending therefrom toward said lever member, so that rotation of the key cylinder about the axis thereof induces an axial movement of the rod;

a play providing device including a pair of spaced stoppers interposed between an extending end of said rod and said lever member, so that play is provided between said rod and said lever upon relative movement therebetween; and a deflector spaced from said pair of spaced stoppers and connected to said rod to move therewith, said deflector having at least a portion extending along said lever of said catching device to prevent tampering with said catching device.

2. A locking device as claimed in claim 1, wherein said play providing device comprises:

a holder pivotally connected to said lever of the catching device, said holder being formed with a projection having therein a hole through which the extending end of the rod slidably passes; and said first and second stoppers being secured to said rod at a spaced distance from each other to locate therebetween the projection of said holder, the spaced distance between said first and second stoppers being greater than the axial length of said projection so that one of said stoppers is always spaced from the projection.

3. A locking device as claimed in claim 2, wherein said deflector is an end portion of said rod bent towards the catching device.

4. A locking device as claimed in claim 2, wherein said deflector is a triangular prism member connected to the extending end of said rod.

5. A locking device as claimed in claim 2, wherein said deflector is an end portion of said rod shaped as a triangular spiral.

6. A locking device as claimed in claim 2, wherein said deflector is a conical member having a conical surface.

7. A locking device as claimed in claim 1, wherein said play providing device comprises:

an enlarged portion of the lever of said catching device, said enlarged portion being formed with an elongate hole; and a bent end portion of said rod, said bent end portion being the extending end passing slidably through the elongate hole, so that the bent end portion is movable in an along the elongate hole.

8. A locking device of an automotive door, comprising a catching device mounted in said door and including a hook member and a lever member, said hook member being locked when said lever member is moved in a first direction and unlocked when said lever member is moved in a second direction; a key cylinder rotatably mounted to said door, said key cylinder being rotatable about an axis thereof in response to rotation of a specified key inserted in the key cylinder; an arm securely connected to an end of said key cylinder and extending radially outward therefrom; a rod pivotally connected to said arm, said rod having a leading end extending therefrom for connection to said lever member so that rotation of the key cylinder induces axial movement of the rod and pivotal movement of the lever member; a play providing device interposed between the leading end of said rod and said lever member to provide play between said rod and said lever member upon relative movement therebetween, said play providing device including a holder pivotally connected to said lever member of the catching device; said holder being formed with a projection having therein a hole through which the leading end portion of the rod slidably passes, and first and second stoppers secured to said rod at a spaced distance from each other to locate therebetween the projection of said holder, the spaced distance between said first and second stoppers being greater than the axial length of said projection; and a protector connected to said rod to cover the lever member of said catching device to prevent tampering therewith, wherein said protector is an end portion of said rod bent towards the catching device.

9. A locking device of an automotive door, comprising a catching device mounted in said door and including a hook member and a lever member, said hook member being locked when said lever member is moved in a first direction and unlocked when said lever member is moved in a second direction; a key cylinder rotatably mounted to said door, said key cylinder being rotatable about an axis thereof in response to rotation of a specified key inserted in the key cylinder; an arm securely connected to an end of said key cylinder and extending radially outward therefrom; a rod pivotally connected to said arm, said rod having the leading end extending therefrom for connection to said lever member so that rotation of the key cylinder induces axial movement of the rod and pivotal movement of the lever member; a play providing device interposed between the leading end of said rod and said lever member to provide play between said rod and said lever member upon relative movement therebetween, said play providing device including a holder pivotally connected to said lever member of the catching device; said holder being formed with a projection having therein a hole through which the leading end portion of the rod slidably passes, and first and second stoppers secured to said rod at a spaced distance from each other to locate therebetween the projection of said holder, the spaced distance between said first and second stoppers being greater than the axial length of said projection; and a protector connected to said rod to cover the lever member of said catching device to prevent tampering therewith, wherein said protector is a triangular prism member connected to the leading end of said rod.

10. A locking device of an automotive door, comprising a catching device mounted in said door and including a hook member and a lever member, said hook member being locked when said lever member is moved in a first direction and unlocked when said lever member is moved in a second direction; a key cylinder rotatably mounted to said door, said key cylinder being rotatable about an axis thereof in response to rotation of a specified key inserted in the key cylinder; an arm securely connected to an end of said key cylinder and extending radially outward therefrom; a rod pivotally connected to said arm, said rod having the leading end extending therefrom for connection to said lever member so that rotation of the key cylinder induces axial movement of the rod and pivotal movement of the lever member; a play providing device interposed between the leading end of said rod and said lever member to provide play between said rod and said lever member upon relative movement therebetween, said play providing device including a holder pivotally connected to said lever member of the catching device; said holder being formed with a projection having therein a hole through which the leading end portion of the rod slidably passes, and first and second stoppers secured to said rod at a spaced distance from each other to locate therebetween the projection of said holder, the spaced distance between said first and second stoppers being greater than the axial length of said projection; and a protector connected to said rod to cover the lever member of said catching device to prevent tampering therewith, wherein said protector is an end portion of said rod shaped as a triangular spiral.

11. A locking device of an automotive door, comprising a catching device mounted in said door and including a hook member and a lever member, said hook member being locked when said lever member is moved in a first direction and unlocked when said lever member is moved in a second direction; a key cylinder rotatably mounted to said door, said key cylinder being rotatable about an axis thereof in response to rotation of a specified key inserted in the key cylinder; an arm securely connected to an end of said key cylinder and extending radially outward therefrom; a rod pivotally connected to said arm, said rod having the leading end extending therefrom for connection to said lever member so that rotation of the key cylinder induces axial movement of the rod and pivotal movement of the lever member; a play providing device interposed between the leading end of said rod and said lever member to provide play between said rod and said lever member upon relative movement therebetween, said play providing device including a holder pivotally connected to said lever member of the catching device; said holder being formed with a projection having therein a hole through which the leading end portion of the rod slidably passes, and first and second stoppers secured to said rod at a spaced distance from each other to locate therebetween the projection of said holder, the spaced distance between said first and second stoppers being greater than the axial length of said projection; and a protector connected to said rod to cover the lever member of said catching device to prevent tampering therewith, wherein said protector is a conical member having a conical surface.

* * * * *